US011184713B2

(12) United States Patent
Sigwanz

(10) Patent No.: US 11,184,713 B2
(45) Date of Patent: Nov. 23, 2021

(54) SYSTEMS AND METHODS FOR ADJUSTING A GAIN LIMIT OF A HEARING DEVICE

(71) Applicant: SONOVA AG, Staefa (CH)

(72) Inventor: Ullrich Sigwanz, Hombrechtikon (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/688,808

(22) Filed: Nov. 19, 2019

(65) Prior Publication Data

US 2021/0152947 A1 May 20, 2021

(51) Int. Cl.
*H04R 25/00* (2006.01)
*H04R 29/00* (2006.01)

(52) U.S. Cl.
CPC ..... *H04R 25/453* (2013.01); *H04R 2225/61* (2013.01)

(58) Field of Classification Search
CPC ..... H04R 25/00; H04R 29/00
USPC ..... 381/60, 312
See application file for complete search history.

(56) References Cited

U.S. PATENT DOCUMENTS

| | | | | |
|---|---|---|---|---|
| 8,107,655 | B1 * | 1/2012 | Howes | H04R 25/552 381/314 |
| 2004/0071304 | A1 * | 4/2004 | Yanz | H04R 25/70 381/312 |
| 2005/0185798 | A1 * | 8/2005 | Camey | H04R 25/356 381/60 |
| 2006/0245610 | A1 | 11/2006 | Chalupper | |
| 2007/0280494 | A1 | 12/2007 | Hamacher | |
| 2010/0177917 | A1 | 7/2010 | Van Der Werf | |
| 2014/0010395 | A1 | 1/2014 | Boldt | |
| 2019/0253817 | A1 | 8/2019 | Callaway | |

FOREIGN PATENT DOCUMENTS

| | | |
|---|---|---|
| EP | 2203000 | 6/2010 |

OTHER PUBLICATIONS

European Search Report received in International Application No. EP20206430, dated Mar. 29, 2021.

* cited by examiner

*Primary Examiner* — Suhan Ni
(74) *Attorney, Agent, or Firm* — ALG Intellectual Property, LLC

(57) ABSTRACT

An exemplary system includes a memory storing instructions and a processor communicatively coupled to the memory. The processor is configured to execute the instructions to concurrently present, within a graphical user interface displayed by a display device, a gain limit curve and a target gain curve representing a target gain profile for the useable gain by a hearing device across a range of frequencies, the target gain curve corresponding to a first sound input level and initially having an amplitude greater than an amplitude of the gain limit curve within a subset of frequencies included in the range of frequencies. The processor is further configured to detect user input representative of a request to increase the amplitude of the gain limit curve, increase a portion of the gain limit curve, and update the gain limit profile in accordance with the increased portion of the gain limit curve.

20 Claims, 12 Drawing Sheets

SYSTEMS AND METHODS FOR ADJUSTING A GAIN LIMIT OF A HEARING DEVICE

BACKGROUND INFORMATION

Hearing devices (e.g., hearing aids) are used to improve the hearing capability and/or communication capability of users. Such hearing devices are configured to process a received input sound signal (e.g., ambient sound) and then provide the processed input sound signal to the user (e.g., by way of a receiver placed in the user's ear canal or at any other suitable location).

When a hearing device is initially provided to a user, and during follow-up tests and checkups thereafter, it is usually necessary to "fit" the hearing device to the user. Fitting of a hearing device to a user is typically performed by an audiologist or the like who presents various stimuli to the user and relies on subjective feedback from the user as to how such stimuli are perceived. Adjustments may be made to specifically tailor the parameters of the hearing device to the user being fitted.

An exemplary parameter of a hearing device that may be adjusted while fitting the hearing device to a user is the amount of gain that may be applied by the hearing device. Typically, the amount of gain that may be applied is limited by a set gain limit that indicates a maximum stable gain that the hearing device can provide across a range of frequencies. However, such a gain limit may restrict the usable gain to a very safe and well sounding limit, which may unnecessarily restrict the useable gain of the hearing device. Although it may be possible to increase the gain limit for the hearing device, doing so may result in a decrease in audio quality due to feedback and/or audible artifacts that may occur as a result of employing feedback cancelling algorithms to mitigate such feedback. Moreover, in such instances, it is difficult for a user such as an audiologist or the like to easily determine how adjusting a gain limit affects performance of the hearing device.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Figure 1:
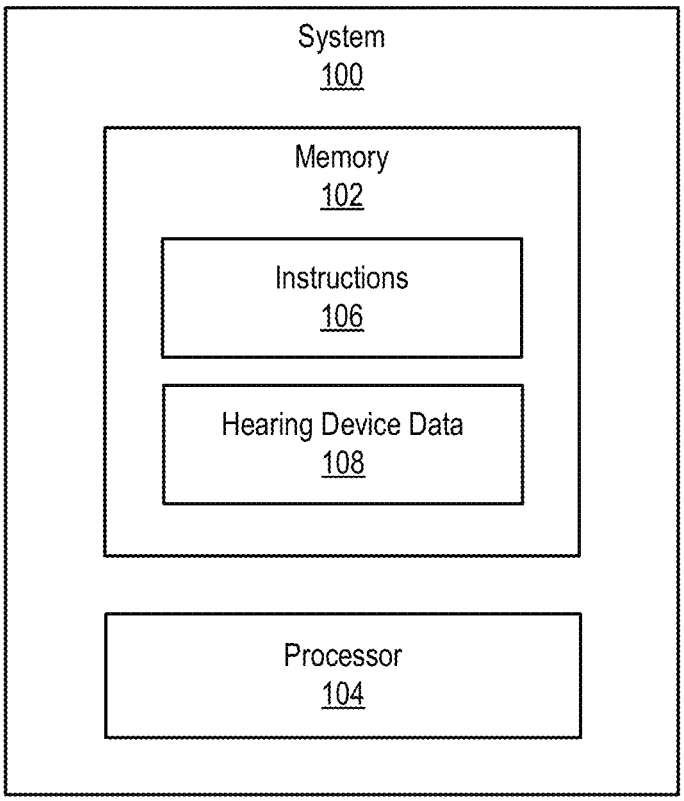
FIG. 1 illustrates an exemplary system according to principles described herein.

Systems and methods for adjusting a gain limit of a hearing device are described herein. As will be described in more detail below, an exemplary system comprises a memory storing instructions and a processor communicatively coupled to the memory. The processor may be configured to execute the instructions to concurrently present, within a graphical user interface displayed by a display device a gain limit curve that may represent a gain limit profile for useable gain by a hearing device across a range of frequencies, and a target gain curve that may represent a target gain profile for the useable gain by the hearing device across the range of frequencies. The target gain curve may correspond to a first sound input level and initially may have an amplitude greater than an amplitude of the gain limit curve within a subset of frequencies included in the range of frequencies. The processor may be further configured to execute the instructions to detect user input representative of a request to increase the amplitude of the gain limit curve, increase, based on the user input, a portion of the gain limit curve that substantially corresponds to the subset of frequencies, and update the gain limit profile in accordance with the increased portion of the gain limit curve.

In another exemplary system, the processor may be configured to execute the instructions to concurrently present, within a graphical user interface displayed by a display device, a gain limit curve that may represent a gain limit profile for useable gain by a hearing device across a range of frequencies, and a target gain curve that may represent a target gain profile for the useable gain by the hearing device across the range of frequencies. The target gain curve may correspond to a first sound input level and may initially have an amplitude greater than an amplitude of the gain limit curve within a subset of frequencies included in the range of frequencies. The processor may be further configured to execute the instructions to provide an option within the graphical user interface for a user to adjust an amplitude of a portion of the gain limit curve that corresponds to the subset of frequencies up to a level that matches or is within a predefined amount greater than the target gain curve within the subset of frequencies.

To illustrate an example, an exemplary system may be implemented in fitting procedure during which, for example, a user such as an audiologist or the like fits a hearing device (e.g., a hearing aid) to a user of the hearing device. During such a fitting procedure, the system may concurrently present, within a graphical user interface displayed by a display device (e.g., on a display screen of a laptop computer, a tablet computer, etc. associated with the system) a gain limit curve representing a gain limit profile for useable gain by a hearing device across a range of frequencies and a target gain curve representing a target gain profile for the useable gain by the hearing device across the range of frequencies. At least a portion of the target gain profile of the target gain curve may have an amplitude that is greater than an amplitude of the gain limit curve within a subset of frequencies included in the range of frequencies. Accordingly, a current setting of the gain limit curve may prohibit the hearing device from reaching the portion of the target gain profile that falls within the subset of frequencies. To facilitate the hearing device being able to provide enough gain to reach the portion of the target gain profile that falls within the subset of frequencies, the system may provide a gain limit adjustment option through which the audiologist may adjust the amplitude of the gain limit curve. For example, the system may provide a graphical object for display within the graphical user interface that the audiologist may select, in any suitable manner, to either increase or decrease the amplitude of the gain limit curve. The system may detect a user input with respect to such a gain limit adjustment option that is representative of a request to increase the amplitude of the gain limit curve. Based on the user input, the system may increase the portion of the gain limit curve that corresponds to the subset of the frequencies. The system may then update the gain limit profile in accordance with the increased portion of the gain limit curve such that the updated gain limit profile of the gain limit curve and the target gain curve are concurrently displayed within the graphical user interface on the display device.

By providing systems, methods, and graphical user interfaces such as those described herein, it is possible to use a target gain curve as a reference for an adjustable a gain limit of a hearing device. In so doing, a user (e.g., a health care professional, an audiologist, etc.) of systems such as those described herein may be able to selectively and appropriately adjust the gain limit to ensure that the usable gain of the hearing device is sufficient to reach one or more target gain curves associated with a user of the hearing device. Further, systems, methods, and graphical user interfaces such as those described herein do not unnecessarily restrict the gain limit to an overly-conservative safe and well-sounding gain limit and, at the same time, do not allow gain limit to be adjusted to a level that would cause the hearing device to become unstable. Furthermore, systems, methods, and graphical user interfaces such as those described herein beneficially leave the decision regarding the gain limit to the user, do not burden the user regarding further hearing device tuning actions, and/or allow the user to focus on reaching target gains without having to memorize stability limits of a hearing device. Moreover, systems, methods, and graphical user interfaces such as those described herein may facilitate a user visualizing compromises or trade-offs that may occur between gain, stability, and/or sound quality as a result of adjusting the gain limit of a hearing device. Other benefits of the systems and associated graphical user interfaces described herein will be made apparent herein.

FIG. 1 illustrates an exemplary system 100 that may be implemented according to principles described herein. As shown, system 100 may include, without limitation, a memory 102 and a processor 104 selectively and communicatively coupled to one another. Memory 102 and processor 104 may each include or be implemented by hardware and/or software components (e.g., processors, memories, communication interfaces, instructions stored in memory for execution by the processors, etc.). In some examples, memory 102 and processor 104 may be distributed between multiple devices (e.g., multiple computing devices) and/or multiple locations as may serve a particular implementation.

Memory 102 may maintain (e.g., store) executable data used by processor 104 to perform any of the operations associated with hearing device 100 described herein. For example, memory 102 may store instructions 106 that may be executed by processor 104 to perform any of the operations associated with system 100 described herein. Instructions 106 may be implemented by any suitable application, software, code, and/or other executable data instance.

As shown in FIG. 1, memory 102 may also store hearing device data 108 that may include any suitable data associated with a hearing device that may be communicatively coupled to system 100. For example, hearing device data 108 may include any suitable settings, control parameters, operating programs, fitting programs, target gain curves, etc. that may be associated with a hearing device communicatively coupled to system 100 and/or a user of the hearing device. In certain examples, hearing device data 108 may include data that is specific to a particular user of a hearing device. For example, hearing device data 108 may include data associated with one or more target gain profiles associated with a particular user.

Memory 102 may also maintain any data received, generated, managed, used, and/or transmitted by processor 104. For example, memory 102 may maintain any data suitable to facilitate communications (e.g., wired and/or wireless communications) between system 100 and one or more hearing devices, such as those described herein. Memory 102 may maintain additional or alternative data in other implementations.

Processor 104 is configured to perform any suitable processing operation that may be associated with system 100. For example, processor 104 may be configured to perform (e.g., execute instructions 106 stored in memory 102 to perform) various processing operations associated with facilitating a user (e.g., an audiologist) adjusting a gain limit for a hearing device. Such processing operations may include providing one or more graphical user interfaces such as those described herein for display to a user to facilitate the user adjusting a gain limit for a hearing device. For example, processor 104 may concurrently present, within a graphical user interface displayed by a display device, a gain limit curve representing a gain limit profile for useable gain by a hearing device across a range of frequencies, and a target gain curve representing a target gain profile for the useable gain by the hearing device across the range of frequencies, detect user input representative of a request to increase the amplitude of the gain limit curve, increase, based on the user input, a portion of the gain limit curve that substantially corresponds to the subset of frequencies, and update the gain limit profile in accordance with the increased portion of the gain limit curve. These and other operations that may be performed by processor 104 are described herein.

Figure 2:
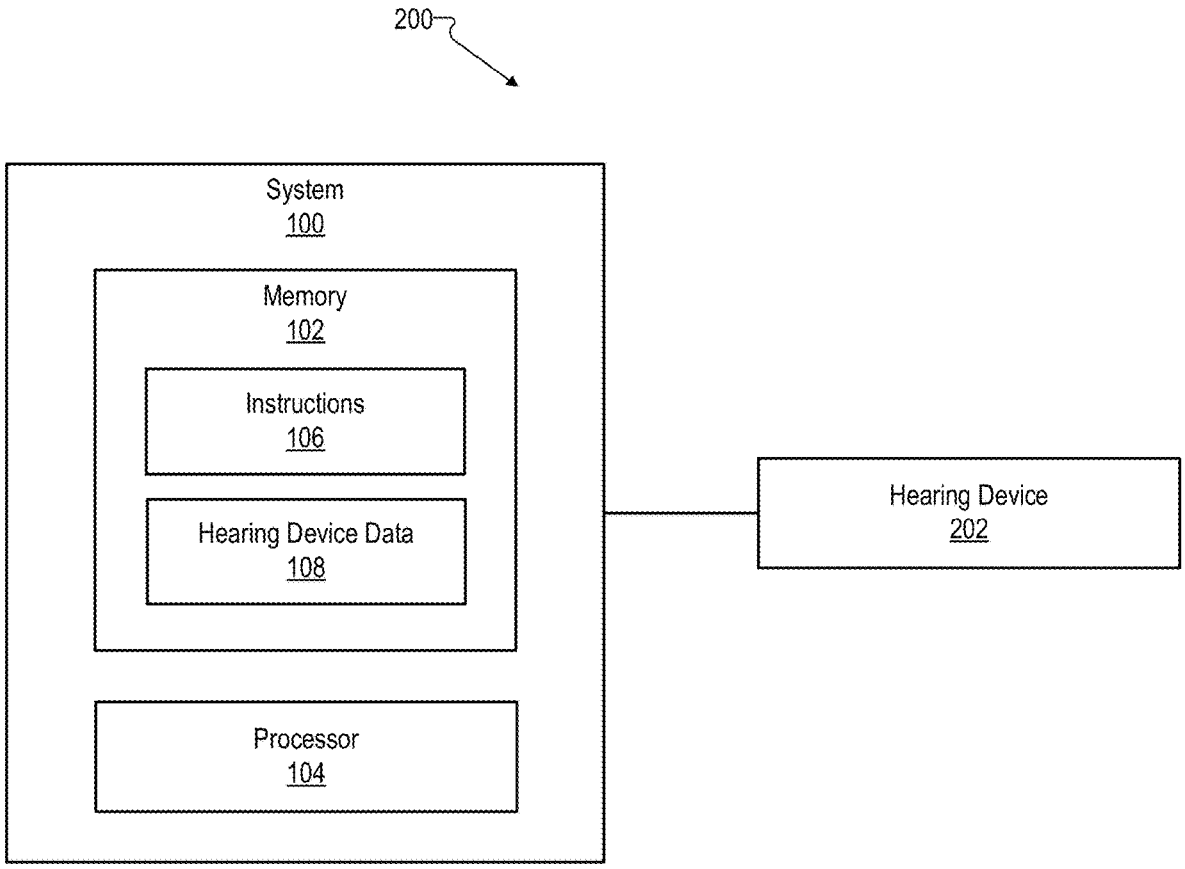
FIG. 2 illustrates an exemplary configuration in which the system of FIG. 1 may be implemented according to principles described herein.

FIG. 2 shows an exemplary configuration 200 in which system 100 may be implemented. As shown in FIG. 2, system 100 is communicatively coupled to a hearing device 202. As used herein, a "hearing device" may be implemented by any device configured to provide or enhance hearing to a user. For example, a hearing device may be implemented by one or more hearing aids configured to amplify audio content to a user, a sound processor included in a cochlear implant system configured to apply electrical stimulation representative of audio content to a user, a sound processor included in a stimulation system configured to apply electrical and acoustic stimulation to a user, or any other suitable hearing prosthesis or combination of hearing prostheses. In some examples, a hearing device may be implemented by a behind-the-ear ("BTE") hearing device configured to be worn behind an ear and/or at least partially within an ear canal of a user.

System 100 may be communicatively coupled to hearing device 202 in any suitable manner and through any suitable communication interface. For example, system 100 may be wirelessly connected to hearing device 202 using any suitable wireless communication protocol. Alternatively, system 100 may be communicatively coupled to hearing device 202 by way of a wired connection.

Although only one hearing device 202 is shown in FIG. 2, it is understood that hearing device 202 may be included in a system that includes more than one hearing device configured to provide or enhance hearing to a user. For example, hearing device 202 may be included in a binaural hearing system that includes two hearing devices, one for each ear. In such examples, hearing device 202 may be provided behind, for example, the left ear of the user and an additional hearing device may be provided behind the right ear of the user. When hearing device 202 is included as part of a binaural hearing system, hearing device 202 may communicate with the additional hearing device by way of a binaural communication link that interconnects hearing device 202 with the additional hearing device. Such a binaural communication link may include any suitable wireless or wired communication link as may serve a particular implementation.

While system 100 is communicatively coupled to hearing device 202, system 100 (e.g., processor 104) may provide various graphical user interfaces for display by a display device to facilitate fitting hearing device 202 to a user. System 100 may provide such graphical user interfaces for display at any suitable time and on any suitable display device that may be part of or communicatively coupled to system 100. For example, such graphical user interfaces may be provided for display to a user by way of a laptop computer, a tablet computer, a smartphone, etc. that may be communicatively coupled to system 100.

In certain examples, system 100 may provide one or more graphical user interfaces for display on a display device to facilitate a user adjusting a gain limit of a hearing device. To that end, system 100 may concurrently present, within a graphical user interface displayed on a display device, a gain limit curve and a target gain curve. As used herein, "a gain limit curve" represents a gain limit profile for useable gain by hearing device 202 across a range of frequencies. The gain limit curve may represent a maximum amount of gain that hearing device 202 is permitted to apply across the range of frequencies. The gain limit curve may represent a most stable gain limit for hearing device 202 where the useable gain does not result in hearing device 202 experiencing feedback and/or some other audible artifact that would reduce sound quality of hearing device 202. A gain limit curve may be generated in any suitable manner. For example, system 100 may generate a gain limit curve based on a feedback test provided with respect to hearing device 202. Alternatively, a gain limit curve may be pre-generated and may be accessed by system 100 in any suitable manner from any suitable source.

In certain examples, the gain limit curve may include sections where the gain limit is adjustable and sections where the gain limit is fixed. For example, the gain limit curve may include a first section in a subset of frequencies included in the range of frequencies where the gain limit is adjustable and a second section outside of the subset of frequencies where the gain limit is not adjustable. In certain alternative examples, an amplitude of the gain limit may be globally adjustable across the range of frequencies. Exemplary gain limit curves will be described herein.

As used herein, a "target gain curve" represents a target gain profile for useable gain by the hearing device across a range of frequencies. The target gain curve may correspond to a particular sound input level. For example, the target gain curve may have a particular target gain profile that is specific to a soft sound input level (e.g., a 50 dB sound input level), a moderate sound input level (e.g., a 65 dB sound input level), a loud sound input level (e.g., an 80 dB sound input level), or any other suitable sound input level. In addition, a target gain curve may be specific to a particular user of hearing device 202. For example, a target gain curve may be unique to a specific user based on the particular user's hearing loss characteristics.

A target gain curve may be generated in any suitable manner. For example, the target gain curve may be generated based on an audiogram of a particular user such that the target gain curve is specific to the particular user's hearing loss characteristics. In certain examples, system 100 may generate a target gain curve for a particular user. Alternatively, a target gain curve may be pre-generated and may be accessed by system 100 in any suitable manner from any suitable source. Exemplary graphical user interfaces that include one or more target gain curves and gain limit curves will now be described with reference to FIGS. 3-10.

Figure 3:
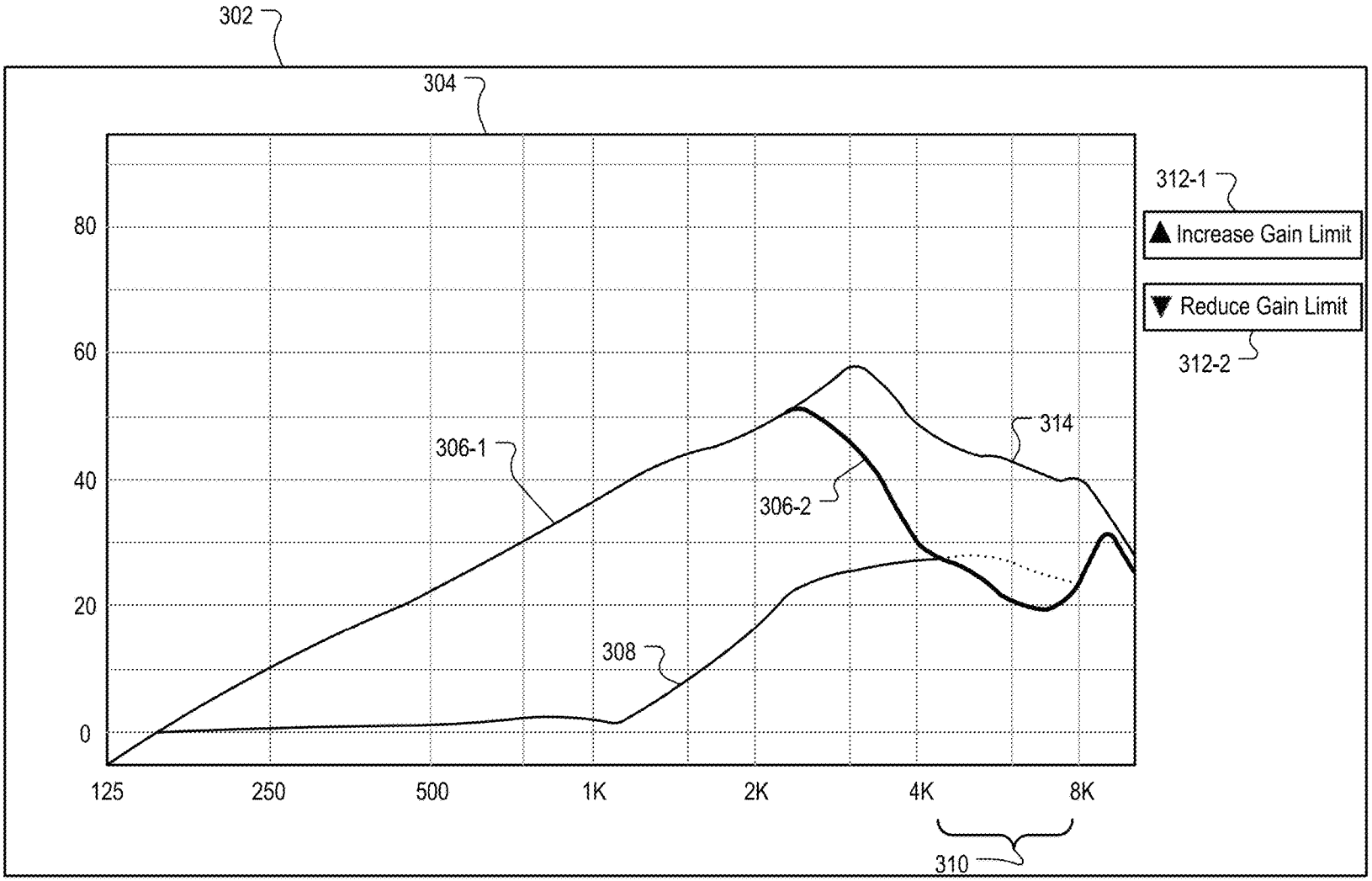
FIGS. 3-10 illustrate exemplary graphical user interfaces that may be provided for display by the system of FIG. 1 according to principles described herein.

System 100 may concurrently present a gain limit curve and a target gain curve within a graphical user interface in any suitable manner. To illustrate, FIG. 3 shows an exemplary graphical user interface 302 that includes a graph 304 in which frequency is indicated along the horizontal axis and an amount of gain is indicated along the vertical axis. As shown in FIG. 3, graph 304 includes a gain limit curve 306 and a target gain curve 308 that are provided across a range of frequencies shown along the horizontal axis.

In the example shown in FIG. 3, gain limit curve 306 includes a first gain limit curve section 306-1 and a second gain limit curve section 306-2. First gain limit curve section 306-1 may represent a section of gain limit curve 306 where an amplitude of the gain limit is not adjustable. On the other hand, second gain limit curve section 306-2 may represent a section of gain limit curve 306 where the amplitude of the gain limit is adjustable. In the example shown in FIG. 3, a curve 314 provided above gain limit curve section 306-2 may represent a maximum gain limit of a closed hearing device system.

Target gain curve 308 represents a target gain profile for the useable gain by hearing device 202 across the range of frequencies shown along the horizontal axis of graph 304 in FIG. 3. As shown in FIG. 3, target gain curve 308 initially has an amplitude that is greater than an amplitude of gain limit curve 306 within a subset of frequencies 310 included in the range of frequencies. The portion of target gain curve 308 that has an amplitude that is greater than an amplitude of gain limit curve 306 is represented by a dotted line in FIG. 3 because the current setting of gain limit curve 306 shown in FIG. 3 prevents hearing device 202 from having enough usable gain to reach target gain curve 308 within subset of frequencies 310.

To facilitate hearing device 202 having sufficient usable gain to reach a target gain curve such as target gain curve 308, system 100 may facilitate a user providing a user input to selectively increase or decrease the gain limit of hearing device 202. System 100 may detect any suitable type of user input as may serve a particular implementation. For example, system 100 may be configured to detect a touch input, an audible command, mouse cursor selection, and/or any other suitable type of user input that may be used to provide a request to adjust a gain limit of hearing device 202.

In certain examples, system 100 may present, within a graphical user interface and together with a gain limit curve and a target gain curve, a gain limit adjustment option. Through the gain limit adjustment option, a user may either increase or decrease an amplitude of a gain limit curve. To illustrate, graphical user interface 304 shown in FIG. 3 further includes a gain limit adjustment section 312 that includes a first icon 312-1 configured facilitate increasing an amplitude of the portion of gain limit curve 306 that corresponds to subset of frequencies 310 and a second icon 321-2 configured to facilitate decreasing the amplitude of the portion of gain limit curve 306 that corresponds to subset of frequencies 310. System 100 may detect, for example, a touch input, a mouse cursor selection, etc. with respect to first icon 312-1 or second icon 312-2 to detect a request to increase or decrease the gain limit.

Based on a detected user input with respect to gain limit adjustment section 312, system 100 may adjust an amplitude of the gain limit curve. It is understood that system 100 may only adjust the amplitude of a portion of a gain limit curve in response to a detected user input. For example, in response to a user input with respect to first icon 312-1, system 100 may only increase the amplitude of gain limit curve section 306-2 that falls within subset of frequencies 310. The amplitude of gain limit curve section 306-1 and amplitude of the remainder of gain limit curve section 306-2 outside of subset of frequencies 310 may not be increased.

System 100 may adjust the portion of the gain limit curve by any suitable amount as may serve a particular implementation. In certain examples, system 100 may adjust the gain limit in a stepwise manner. For example, system 100 may adjust the gain limit by a predefined amount each time a user input is detected. In such examples, each time system 100 detects a user input with respect to first icon 312-1, system 100 may increase an amplitude the gain limit by a predefined amount. Similarly, each time system 100 detects a user input with respect to second icon 312-2, system 100 may decrease an amplitude of the gain limit by a predefined amount. In such examples, a plurality of user inputs may be detected by system 100 before the gain limit within subset of frequencies 310 is increased to a level that matches or that is greater than target gain curve 308 shown in FIG. 3.

In certain alternative examples, system 100 may increase the gain limit such that the amplitude of gain limit curve 306 within subset of frequencies 310 matches or is a predefined amount greater than target gain curve 308 within subset of frequencies 310. System may increase the amplitude of gain limit curve 306 in such a manner in response to a single user input provided by way of first icon 312-1.

In certain examples, first icon 312-1 and second icon 312-2 may be visually different from one another depending on whether it is possible to either decrease or increase the gain limit at a given time. For example, in graphical user interface 302 shown in FIG. 3, the amplitude of gain limit curve 306 may represent a most stable gain limit for hearing device 202. As such, it may not be possible or desirable to decrease the gain limit associated with gain limit curve 306 below what is currently shown in graph 304. Accordingly, in such examples, second icon 312-2 may be disabled, grayed out, or otherwise excluded in any suitable manner from graphical user interfaces such as those described herein. Similarly, in certain examples, an amplitude of second gain limit section 306-2 may be increased to a setting for maximum usable gain such that it is no longer possible to increase the amplitude further. Accordingly, in such examples, first icon 312-1 may be disabled, grayed out, or otherwise excluded in any suitable manner from graphical user interfaces such as those described herein.

Figure 4:
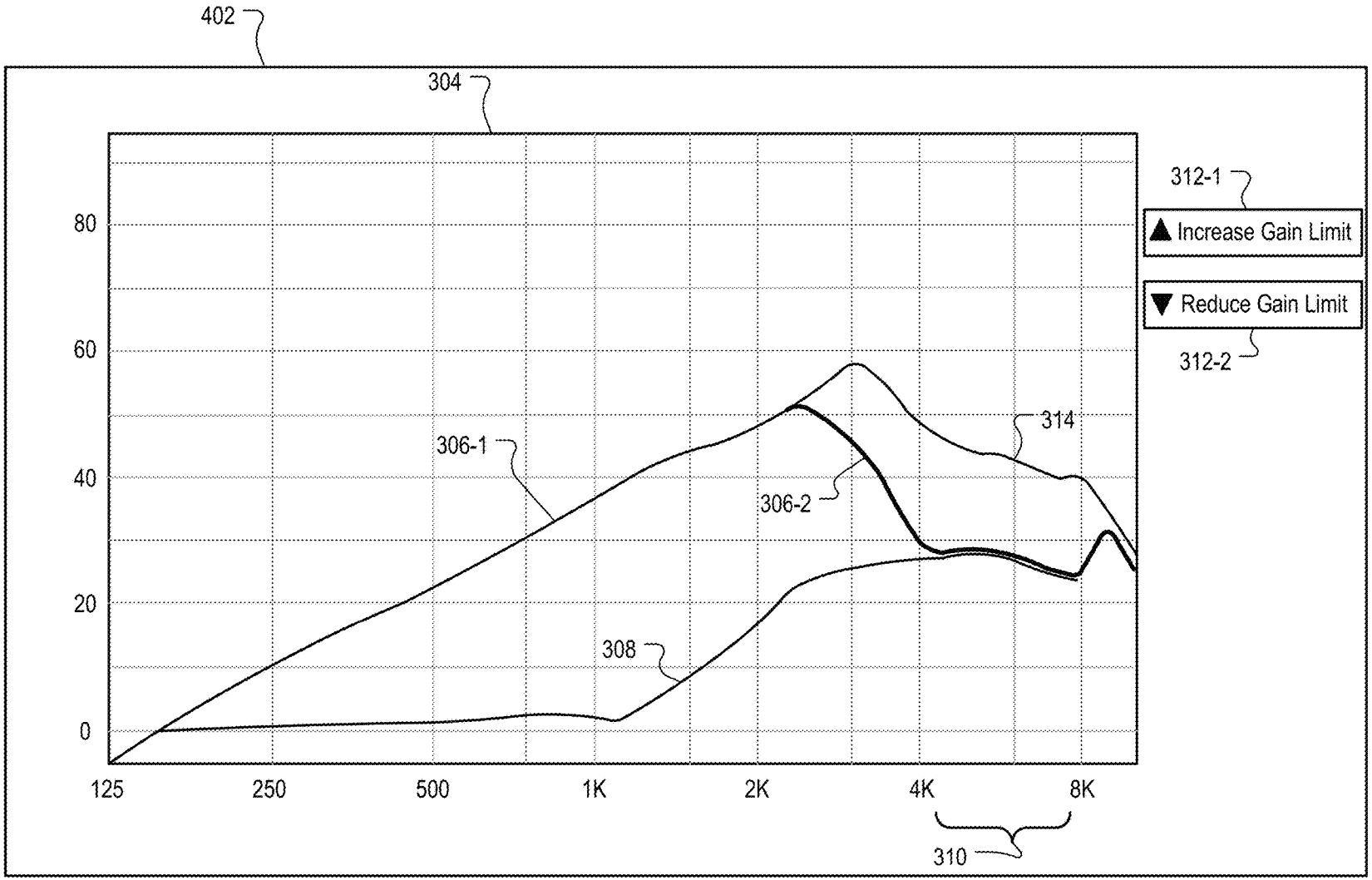

After system 100 adjusts an amplitude of gain limit curve 306, system 100 may update the gain limit profile in accordance with an increased portion of gain limit curve 306. To illustrate, FIG. 4 shows an updated graphical user interface 402 that may be provided for display by system 100 in response to system 100 detecting a request to increase the amplitude of gain limit curve 306. As shown in FIG. 4, the increased portion of gain limit curve 306 within subset of frequencies 310 is now greater than the portion of target gain curve 308 within subset of frequencies 310. As such, the portion of target gain curve 308 within subset of frequencies 310 is shown as a solid line in FIG. 4 to indicate that there is now sufficient usable gain for hearing device 202 to reach the target gain profile represented by target gain curve 308.

In certain examples, after system 100 updates the gain limit profile, system 100 may be configured to transmit information indicative of the updated gain limit profile to hearing device 202. In so doing, hearing device 202 may be configured to operate in accordance with the updated gain limit profile. System 100 may transmit the information indicative of the updated gain limit profile to hearing device 202 in any suitable manner, such as described herein.

System 100 may be configured to detect any suitable number of user inputs representative of requests to adjust a gain limit of hearing device 202 as may serve a particular implementation. For example, after system 100 provides graphical user interface 402 for display to a user, system 100 may detect an additional user input representative of an additional request to increase the amplitude of gain limit curve 306. Based on the additional user input, system 100 may further increase the increased portion of gain limit curve 306 that corresponds to subset of frequencies 310. System 100 may then update the gain limit profile again in accordance with the further increased portion of gain limit curve 306.

Alternatively, after system 100 provides graphical user interface 402 for display to a user, system 100 may detect an additional user input representative of a request to decrease the amplitude of gain limit curve 306. Based on the additional user input, system 100 may decrease the increased portion of the gain limit curve that corresponds to subset of frequencies 310. System 110 may then update the gain limit profile again in accordance with the decreased portion of gain limit curve 306.

In certain examples, adjusting a portion of a gain limit curve may result in a hearing device operating condition that may affect how hearing device 202 performs. As used herein, a "hearing device operating condition" may correspond to any effect and/or change in performance of hearing device 202 that may occur as a result of adjusting a portion of the gain limit curve. For example, an increase in a portion of gain limit curve 306 may result feedback being experienced by hearing device 202. To mitigate the feedback that may occur, hearing device 202 may be configured to implement one or more feedback canceling algorithms. However, such feedback canceling algorithms may produce audible artifacts in certain areas of frequency and gain. To facilitate a user understanding when such hearing device operating conditions may occur, system 100 may be configured to determine whether a hearing device operating condition that is predicted to occur. System 100 may determine whether a hearing device operating condition is predicted to occur in any suitable manner. For example, system 100 may use hearing device data 108 in any suitable manner to determine which areas of gain and frequency would be subject to feedback canceling and also to which amount.

Figure 5:
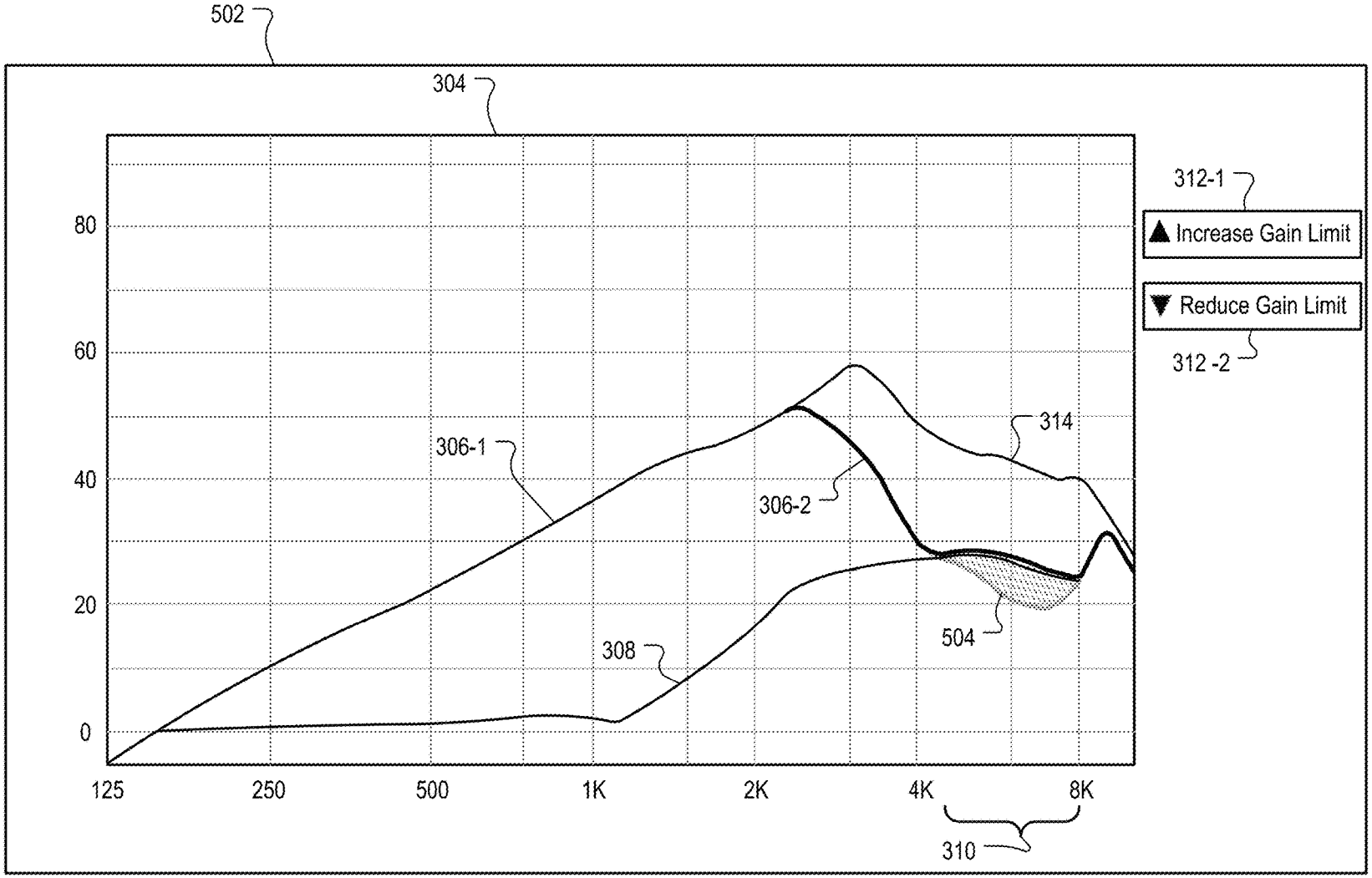

If system 100 determines that a hearing device operating condition is predicted to occur, system 100 may concurrently present, within the graphical user interface displayed by the display device and together with the gain limit curve and the target gain curve, a graphical object that visually indicates the hearing device operating condition. System may present such a graphical object within a graphical user interface in any suitable manner. To illustrate an example, FIG. 5 shows an alternative updated graphical user interface 502 that may be provided for display by system 100 in response to a detected user input with respect first icon 312-1 shown in FIG. 3. As shown in FIG. 5, graphical user interface 502 is similar to graphical user interface 402 shown in FIG. 4 except that graphical user interface 502 includes a graphical object 504, which visually identifies an area of gain and/or frequency where a hearing device condition is predicted to occur. For example, graphical object 504 may indicate an area of gain and/or frequency where hearing device 202 is configured to implement a feedback canceling algorithm. With such features, system 100 is configured to provide a visual indication of the expected acoustic stability and sound quality of hearing device 202. As such, a user of system 100 may be able to readily and easily determine what trade-offs in hearing device performance may occur as a result of increasing a gain limit of hearing device 202 to the amplitude shown in FIG. 5.

Figure 6:
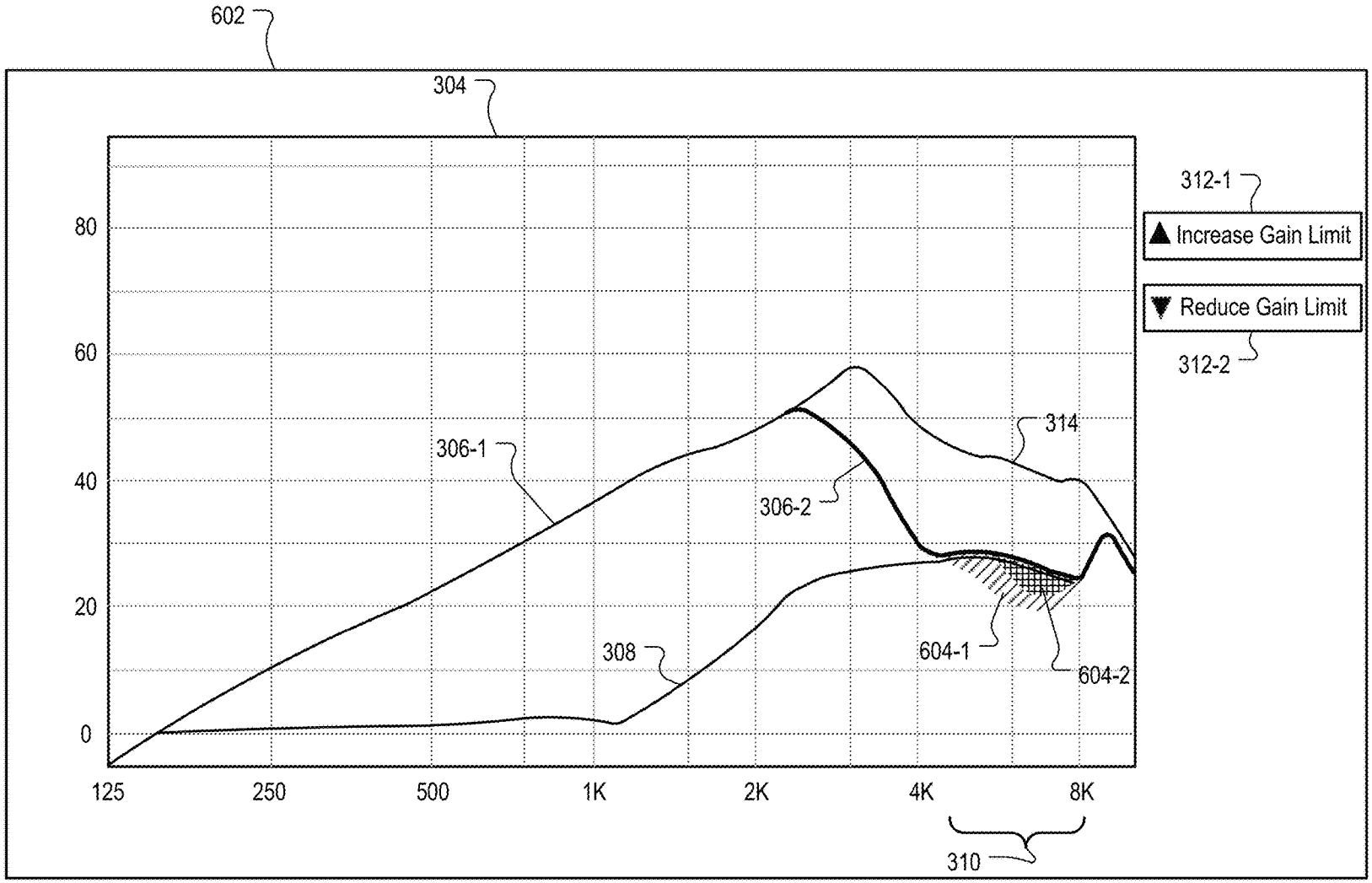

In certain examples, a graphical object that visually indicates a hearing device operating condition may include a plurality of sections that visually indicate different levels of a hearing device operating condition that may occur as a result of adjusting a gain limit. For example, a first section of a graphical object that visually indicates a hearing device operating condition may indicate a first level of feedback canceling that may occur. A second section of a graphical object that visually indicates a hearing device operating condition may indicate a second level of feedback canceling that may occur that is relatively more than the first level of feedback canceling. Each section included in the plurality of sections may have a particular shade and relatively darker shaded sections included in the plurality of sections may indicate areas of gain and frequency where relatively more feedback cancelling is configured to be implemented to mitigate the feedback. To illustrate an example, FIG. 6 shows an alternative updated graphical user interface 602 that may be provided for display by system 100 in response to a detected user input with respect first icon 312-1 shown in FIG. 3. As shown in FIG. 6, graphical user interface 602 concurrently presents an updated gain limit curve 306, target gain curve 308, and a graphical object 604 that includes a first section 604-1 and a second section 604-2. First section 604-1 may indicate to a user of system 100 that a first amount of feedback canceling will occur in an area of gain and/or frequency defined by first section 604-1. On the other hand, second section 604-2 may indicate to a user of system 100 that a second amount of feedback canceling that is relatively larger than the first amount of feedback canceling will occur in an area of gain and/or frequency defined by second section 604-2. In the example shown in FIG. 6, the relatively darker cross hatching of second section 604-2 may indicate to a user of system 100 that relatively more feedback canceling is predicted to occur in the area defined by second section 604-2 than in the area defined by first section 604-1.

Figure 7:
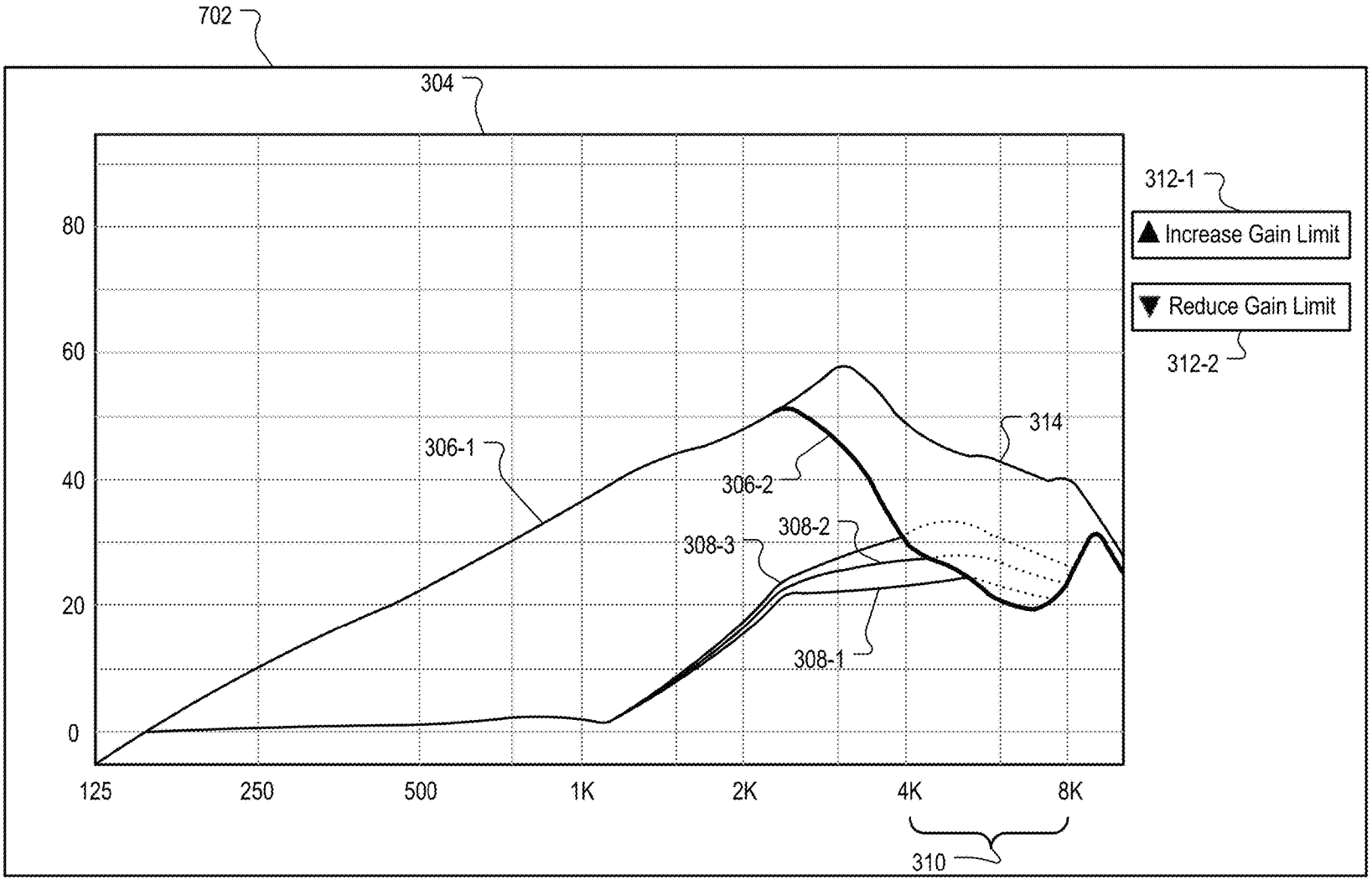

FIG. 7 illustrates an exemplary graphical user interface 702 that may be provided for display by system 100 in certain examples. As shown in FIG. 7, graphical user interface 702 includes a plurality of target gain curves 308 (e.g., target gain curves 308-1 through 308-3). Each target gain curve 308 shown in graphical user interface 702 may represent a different target gain profile for the useable gain by hearing device 202 across the range of frequencies shown in FIG. 7. In addition, each target gain curve 308 shown in FIG. 7 may correspond to a different sound input level included in a plurality of sound input levels. For example, target gain curve 308-1 may correspond to an 80 dB sound input level, target gain curve 308-2 may correspond to a 65 dB sound input level, and target gain curve 308-3 may correspond to a 50 dB sound input level. Each target gain profile represented in FIG. 7 may be specific to a particular user of hearing device 202.

Although only three target gain curves are illustrated in FIG. 7, it is understood that any suitable number of target gain curves may be displayed within a graphical user interface as may serve a particular implementation.

As shown in FIG. 7, each of target gain curves 308-1 through 308-3 include a portion shown in dotted lines that has an amplitude that is greater than the current amplitude of gain limit curve section 306-2. As such, with the current setting of gain limit curve 306, there is not enough usable gain to permit hearing device 202 to reach the dotted line portions of the target gain curves 308-1 through 308-3 included in subset of frequencies 310.

Figure 8:
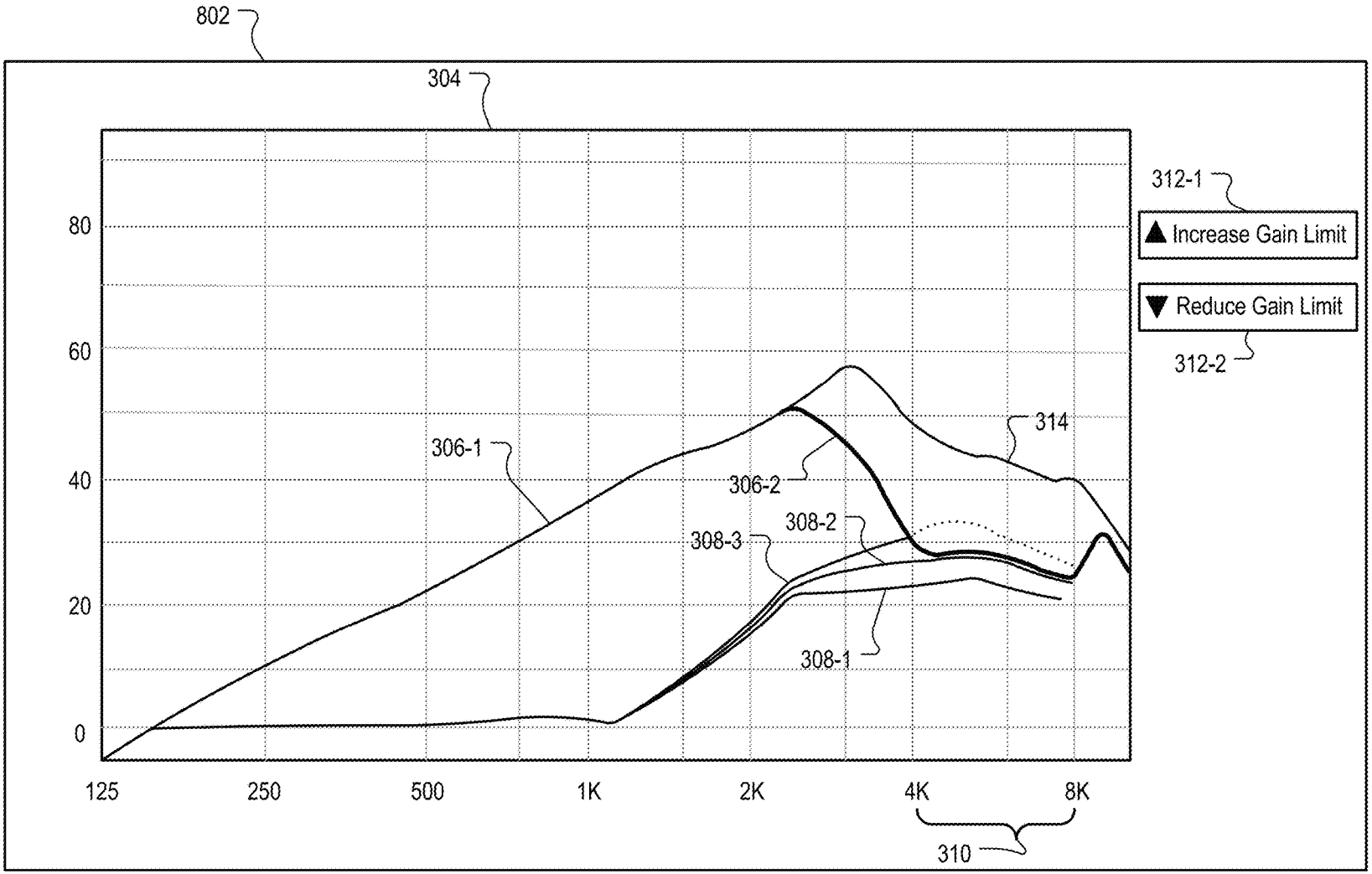

To facilitate hearing device 202 reaching one or more of the portions of the target gain curves 308-1 through 308-3 included in subset of frequencies 310, system 100 may detect one or more user inputs with respect to first icon 312-1. In response to the one or more user inputs provided with respect to first icon 312-1, system 100 may increase the amplitude of gain limit curve section 306-2 and update graphical user interface 702 accordingly. To illustrate, FIG. 8 shows an updated graphical user interface 802 that is similar to graphical user interface 702 shown in FIG. 7 except that the amplitude of the portion of gain limit curve section 306-2 that is within subset of frequencies 310 has been increased in response to a user input. Based on the increase in the amplitude of gain limit curve section 306-2, target gain curves 308-1 and 308-2 are shown in solid lines indicating that there is now sufficient usable gain to reach the target gain profiles associated with target gain curves 308-1 and 308-2. System 100 may detect further user inputs with respect to first icon 312-1 shown in FIG. 8 and, based on such user inputs, further increase the amplitude of gain limit curve section 306-2 such that there is sufficient usable gain to reach the target gain profile associated with target gain curve 308-3 within subset of frequencies 310.

Alternatively, system 100 may detect one or more user inputs with respect to second icon 312-2 and, in response, decrease the amplitude of gain limit curve section 306-2 within subset of frequencies 310 in any suitable manner, such as described herein.

Figure 9:
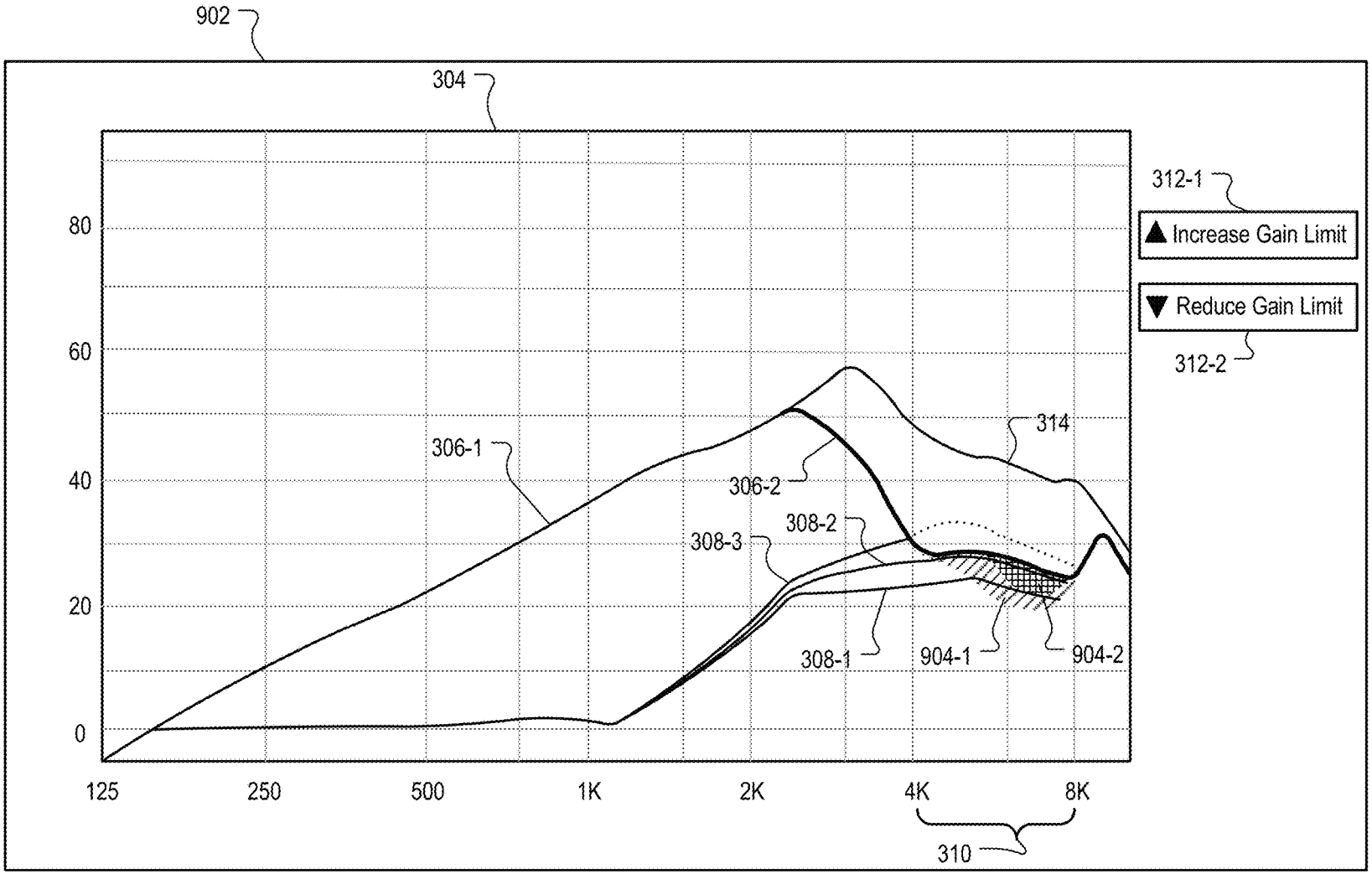

FIG. 9 illustrates an exemplary alternative graphical user interface 902 that may be provided for display by system 100 after system 100 updates graphical user interface 702. As shown in FIG. 9, graphical user interface 902 includes a graphical object 904 that includes a first section 904-1 and a second section 904-2. Similar to graphical user interface 302 shown in FIG. 6, first section 904-1 may indicate to a user of system 100 that a first amount of feedback canceling will occur in an area of gain and/or frequency defined by first section 904-1. On the other hand, second section 904-2 may indicate to a user of system 100 that a second amount of feedback canceling that is relatively larger than the first amount of feedback canceling will occur in an area of gain and/or frequency defined by second section 904-2. In addition, in graphical user interface 902, the relatively darker cross hatching of second section 904-2 may indicate to a user of system 100 that relatively more feedback canceling is predicted to occur in the area defined by second section 904-2 than in the area defined by first section 904-1.

From graphical user interface 902 shown in FIG. 9, a user of system 100 may be able to readily determine the compromises or trade-offs that may be associated with adjusting the amplitude of gain limit curve 306 to the amplitude shown in FIG. 9. For example, with the portion of gain limit curve section 306-2 increased as shown in FIG. 9, a portion of target gain curve 308-2 passes directly through second section 904-2. As such, relatively more feedback canceling may be required to reach all of the target gain profile associated with target gain curve 308-2, which may result in relatively more audible artifacts being experienced by a user of hearing device 202 at the sound input level associated with target gain curve 308-2. The user of system 100 may determine that such audible artifacts are unacceptable at the sound input level associated with target gain curve 308-2. As such, the user of system 100 may provide a user input with respect to second icon 312-2 representative of a request to decrease the gain limit. In response to such a user input, system 100 may decrease the amplitude of gain limit curve 306 within subset of frequencies 310 such that the amplitude of gain limit curve 306 is, for example, between target gain curve 308-2 and target gain curve 308-1 within subset of frequencies 310.

Figure 10:
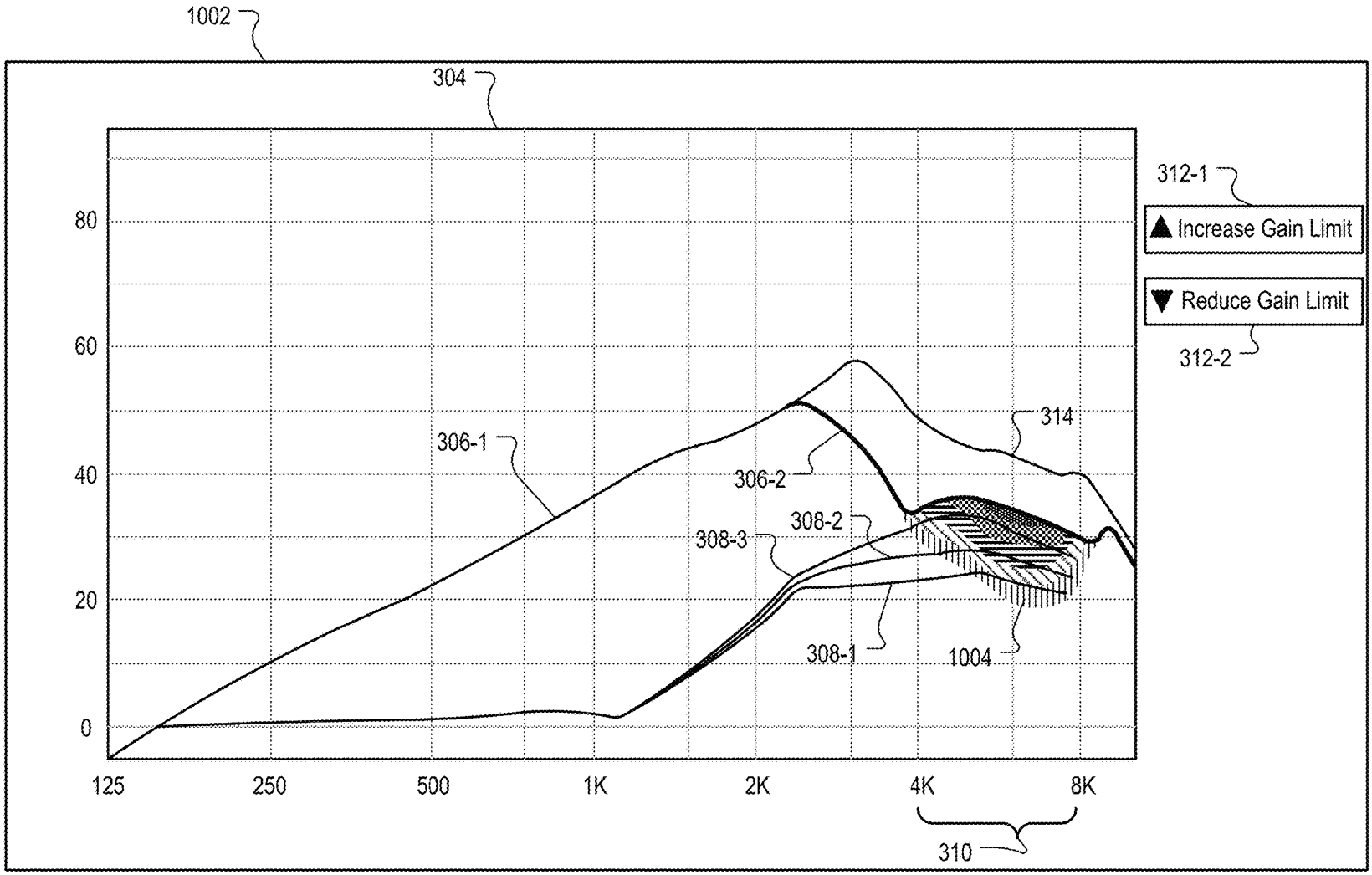

FIG. 10 illustrates an exemplary updated graphical user interface 1002 that may be provided for display by system 100 in certain examples in response to one or more user inputs detected with respect to first icon 312-1. As shown in FIG. 10, the amplitude of gain limit curve 306 has been increased to a level that is higher than each of target gain curves 308-1 through 308-3. Graphical user interface 1002 further includes a graphical object 1004 that provides a visual indication of a hearing device operating condition that may occur as a result of increasing the amplitude of gain limit curve 306 to the level shown in FIG. 10. In certain examples, each differently cross-hatched section of graphical object 1004 shown in FIG. 10 may provide an indication to the user of system 100 of where and what amount of feedback canceling may occur as a result of increasing the amplitude of gain limit curve section 306-2. In the example shown in FIG. 10, the relatively darker portions of graphical object 1004 indicate areas of gain and frequency were relatively more feedback canceling will be implemented. Through the combination of gain limit curve 306, target gain curves 308-1 through 308-3, and graphical object 1004, a user of system 100 may be able to readily determine compromises or trade-offs that may occur as a result of increasing the amplitude of gain limit curve section 306-2 to the level shown in FIG. 10.

Figure 11:
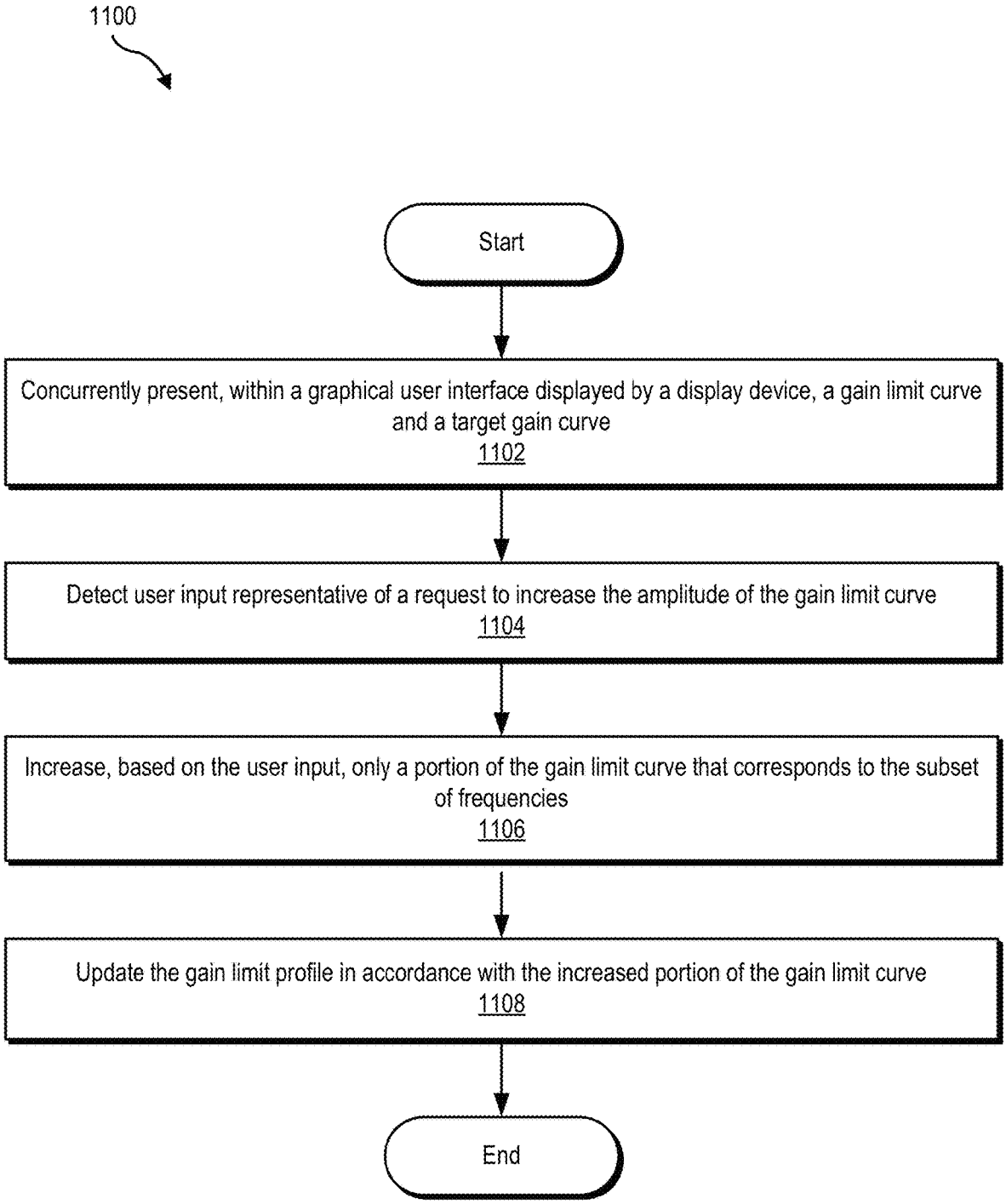
FIG. 11 illustrates an exemplary method for adjusting a gain limit of a hearing device according to principles described herein.

FIG. 11 illustrates an exemplary method for adjusting a gain limit of a hearing device (e.g., hearing device 202). While FIG. 11 illustrates exemplary operations according to one embodiment, other embodiments may omit, add to, reorder, and/or modify any of the operations shown in FIG. 11. One or more of the operations shown in FIG. 11 may be performed by a system such as system 100, any components included therein, and/or any implementation thereof.

In operation 1102, a processor (e.g., processor 104) may concurrently present, within a graphical user interface displayed by a display device, a gain limit curve and a target gain curve. The gain limit curve presented within the graphical user interface may represent a gain limit profile for useable gain by a hearing device across a range of frequencies. The target gain curve presented in the graphical user interface may represent a target gain profile for the useable gain by the hearing device across the range of frequencies. The target gain curve may correspond to a first sound input level and may initially have an amplitude greater than an amplitude of the gain limit curve within a subset of frequencies included in the range of frequencies. Operation 1102 may be performed in any of the ways described herein.

In operation 1104, the processor may detect user input representative of a request to increase the amplitude of the gain limit curve. Operation 1104 may be performed in any of the ways described herein.

In operation 1106, the processor may increase, based on the user input, a portion of the gain limit curve that substantially corresponds to the subset of frequencies. In certain examples, the processor may only increase the portion of the gain limit curve that substantially corresponds to the subset of the frequencies. That is, in response to the user input, the processor may not increase other portions of the gain limit curve that do not substantially correspond to the subset of the frequencies. Operation 1106 may be performed in any of the ways described herein.

In operation 1108, the processor may update the gain limit profile in accordance with the increased portion of the gain limit curve. Operation 1108 may be performed in any of the ways described herein.

In some examples, a non-transitory computer-readable medium storing computer-readable instructions may be provided in accordance with the principles described herein. The instructions, when executed by a processor of a computing device, may direct the processor and/or computing device to perform one or more operations, including one or more of the operations described herein. Such instructions may be stored and/or transmitted using any of a variety of known computer-readable media.

A non-transitory computer-readable medium as referred to herein may include any non-transitory storage medium that participates in providing data (e.g., instructions) that may be read and/or executed by a computing device (e.g., by a processor of a computing device). For example, a non-transitory computer-readable medium may include, but is not limited to, any combination of non-volatile storage media and/or volatile storage media. Exemplary non-volatile storage media include, but are not limited to, read-only memory, flash memory, a solid-state drive, a magnetic storage device (e.g. a hard disk, a floppy disk, magnetic tape, etc.), ferroelectric random-access memory ("RAM"), and an optical disc (e.g., a compact disc, a digital video disc, a Blu-ray disc, etc.). Exemplary volatile storage media include, but are not limited to, RAM (e.g., dynamic RAM).

Figure 12:
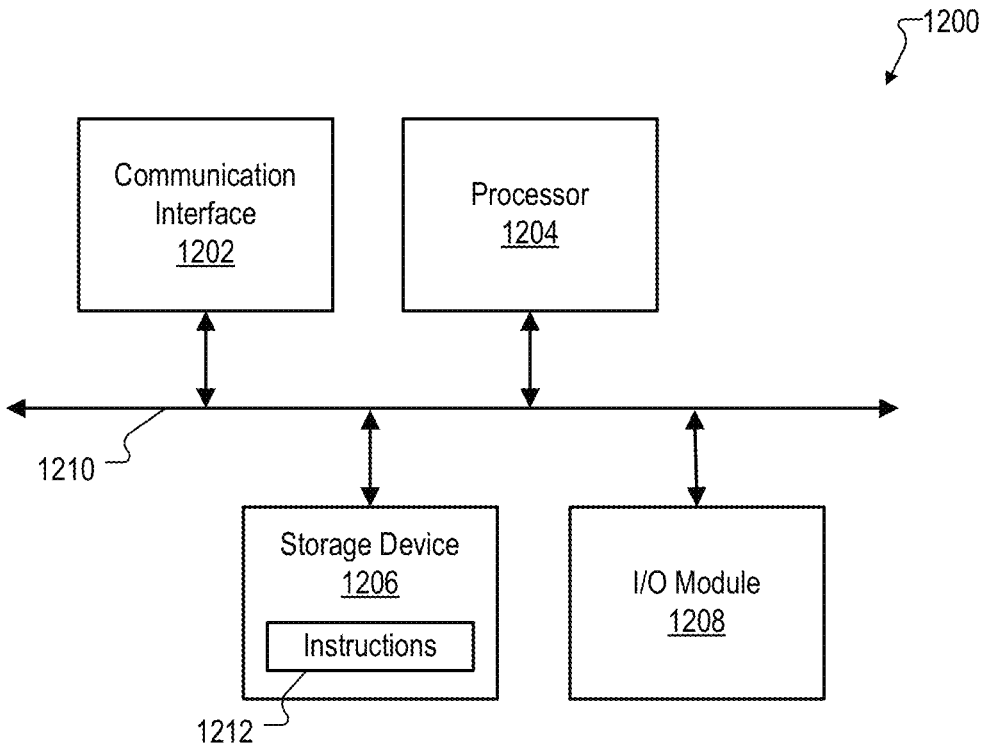
FIG. 12 illustrates an exemplary computing device according to principles described herein.

FIG. 12 illustrates an exemplary computing device 1200 that may be specifically configured to perform one or more of the processes described herein. As shown in FIG. 12, computing device 1200 may include a communication interface 1202, a processor 1204, a storage device 1206, and an input/output ("I/O") module 1208 communicatively connected one to another via a communication infrastructure 1210. While an exemplary computing device 1200 is shown in FIG. 12, the components illustrated in FIG. 12 are not intended to be limiting. Additional or alternative components may be used in other embodiments. Components of computing device 1200 shown in FIG. 12 will now be described in additional detail.

Communication interface 1202 may be configured to communicate with one or more computing devices. Examples of communication interface 1202 include, without limitation, a wired network interface (such as a network interface card), a wireless network interface (such as a wireless network interface card), a modem, an audio/video connection, and any other suitable interface.

Processor 1204 generally represents any type or form of processing unit capable of processing data and/or interpreting, executing, and/or directing execution of one or more of the instructions, processes, and/or operations described herein. Processor 1204 may perform operations by executing computer-executable instructions 1212 (e.g., an application, software, code, and/or other executable data instance) stored in storage device 1206.

Storage device 1206 may include one or more data storage media, devices, or configurations and may employ any type, form, and combination of data storage media and/or device. For example, storage device 1206 may include, but is not limited to, any combination of the non-volatile media and/or volatile media described herein.

Electronic data, including data described herein, may be temporarily and/or permanently stored in storage device 1206. For example, data representative of computer-executable instructions 1212 configured to direct processor 1204 to perform any of the operations described herein may be stored within storage device 1206. In some examples, data may be arranged in one or more databases residing within storage device 1206.

I/O module 1208 may include one or more I/O modules configured to receive user input and provide user output. One or more I/O modules may be used to receive input for a single virtual experience. I/O module 1208 may include any hardware, firmware, software, or combination thereof supportive of input and output capabilities. For example, I/O module 1208 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 1208 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 1208 is configured to provide graphical data to a display for presentation to a user. The graphical data may be representative of one or more graphical user interfaces and/or any other graphical content as may serve a particular implementation.

In some examples, any of the systems, hearing devices, and/or other components described herein may be implemented by computing device 1200. For example, memory 102 may be implemented by storage device 1206, and processor 104 may be implemented by processor 1204.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A system comprising:

a memory storing instructions; and a processor communicatively coupled to the memory and configured to execute the instructions to:

concurrently present, within a graphical user interface displayed by a display device, a gain limit curve representing a gain limit profile for useable gain by a hearing device across a range of frequencies and representing a most stable gain limit for the hearing device across the range of frequencies, and a target gain curve representing a target gain profile for the useable gain by the hearing device across the range of frequencies, the target gain curve corresponding to a first sound input level and initially having an amplitude greater than an amplitude of the gain limit curve within a subset of frequencies included in the range of frequencies;

detect user input representative of a request to increase the amplitude of the gain limit curve;

increase, based on the user input, a portion of the gain limit curve that substantially corresponds to the subset of frequencies; and update the gain limit profile in accordance with the increased portion of the gain limit curve.

2. The system of claim 1, wherein the target gain profile is specific for a particular user of the hearing device.

3. The system of claim 1, wherein the processor is further configured to execute the instructions to:

detect an additional user input representative of an additional request to increase the amplitude of the gain limit curve;

further increase, based on the additional user input, the increased portion of the gain limit curve that corresponds to the subset of frequencies; and update the gain limit profile again in accordance with the further increased portion of the gain limit curve.

4. The system of claim 1, wherein the processor is further configured to execute the instructions to:

detect an additional user input representative of a request to decrease the amplitude of the gain limit curve;

decrease, based on the additional user input, the increased portion of the gain limit curve that corresponds to the subset of frequencies; and update the gain limit profile again in accordance with the decreased portion of the gain limit curve.

5. The system of claim 1, wherein the increasing of the portion of the gain limit curve that corresponds to the subset of frequencies includes increasing the portion of the gain limit curve by a predefined amount based on the user input.

6. The system of claim 1, wherein the increasing of the portion of the gain limit curve that corresponds to the subset of frequencies includes increasing the portion of the gain limit curve such that the amplitude of the gain limit curve within the subset of frequencies matches or is a predefined amount greater than the target gain curve.

7. The system of claim 1, wherein:

the processor is further configured to execute the instructions to concurrently present, within the graphical user interface displayed by the display device and together with the gain limit curve and the target gain curve, a gain limit adjustment option; and the detecting of the user input representative of the request includes detecting a selection by a user of the gain limit adjustment option.

8. The system of claim 7, wherein the gain limit adjustment option includes:

a first icon configured to facilitate increasing an amplitude of the portion of the gain limit curve that corresponds to the subset of frequencies; and a second icon configured to facilitate decreasing the amplitude of the portion of the gain limit curve that corresponds to the subset of frequencies.

9. The system of claim 1, wherein:

the target gain curve includes a plurality of target gain curves;

each target gain curve included in the plurality of target gain curves represents a different target gain profile for the useable gain by the hearing device across the range of frequencies; and each target gain curve included in the plurality of target gain curves corresponds to a different sound input level included in a plurality of sound input levels.

10. The system of claim 9, wherein each different target gain profile is specific for a particular user of the hearing device.

11. The system of claim 9, wherein the plurality of target gain curves includes at least one of:

a first target gain curve that corresponds to a loud sound input level, in particular to an 80 dB sound input level;

a second target gain curve that corresponds to a moderate sound input level, in particular to a 65 dB sound input level; and a third target gain curve that corresponds to a soft sound input level, in particular to a 50 dB sound input level.

12. The system of claim 1, wherein the processor is further configured to execute the instructions to:

determine a hearing device operating condition that is predicted to occur as a result of the increasing of the portion of the gain limit curve; and concurrently present, within the graphical user interface displayed by the display device and together with the updated gain limit profile and the target gain curve, a graphical object that visually indicates the hearing device operating condition.

13. The system of claim 12, wherein:

the hearing device operating condition is associated with feedback; and the graphical object indicates an area of gain and/or frequency where feedback canceling is configured to be implemented to mitigate the feedback.

14. The system of claim 13, wherein:

the graphical object includes a plurality of sections; and each section included in the plurality of sections represents a particular area of gain and/or frequency where a particular amount of feedback canceling is configured to be implemented to mitigate the feedback.

15. The system of claim 14, wherein:

each section included in the plurality of sections has a particular shade; and relatively darker shaded sections included in the plurality of sections indicate areas of gain and frequency where relatively more feedback cancelling is configured to be implemented to mitigate the feedback.

16. The system of claim 1, wherein the processor is further configured to execute the instructions to transmit information indicative of the updated gain limit profile to the hearing device.

17. The system of claim 1, wherein the processor is further configured to execute the instructions to provide an option within the graphical user interface for a user to adjust an amplitude of a portion of the gain limit curve that corresponds to the subset of frequencies up to a level that matches or is within a predefined amount greater than the target gain curve within the subset of frequencies.

18. The system of claim 17, wherein:

the detecting of the user input includes detecting a user selection of the option; and the updating of the gain limit profile includes adjusting, based on the user selection of the option, the amplitude of the portion of the gain limit curve that corresponds to the subset of the frequencies up to the level that matches or is within a predefined amount greater than the target gain curve within the subset of frequencies.

19. The system of claim 1, wherein the gain limit curve includes a first section in the subset of frequencies where a gain limit of the hearing device is adjustable and a second section outside of the subset of frequencies where the gain limit is not adjustable.

20. A method comprising:

concurrently presenting, by a processor and within a graphical user interface displayed by a display device, a gain limit curve representing a gain limit profile for useable gain by a hearing device across a range of frequencies and representing a most stable gain limit for the hearing device across the range of frequencies, and a target gain curve representing a target gain profile for the useable gain by the hearing device across the range of frequencies, the target gain curve corresponding to a first sound input level and initially having an amplitude greater than an amplitude of the gain limit curve within a subset of frequencies included in the range of frequencies;

detecting, by the processor, user input representative of a request to increase the amplitude of the gain limit curve;

increasing, by the processor based on the user input, a portion of the gain limit curve that substantially corresponds to the subset of frequencies; and updating, by the processor, the gain limit profile in accordance with the increased portion of the gain limit curve.

* * * * *